United States Patent [19]

Dietrich

[11] Patent Number: 4,973,176

[45] Date of Patent: Nov. 27, 1990

[54] APPENDAGE REST

[76] Inventor: Jeffrey A. Dietrich, 526 Tallyrand, Wichita, Kans. 67206

[21] Appl. No.: 286,527

[22] Filed: Dec. 20, 1988

[51] Int. Cl.[5] ..... B41J 29/00

[52] U.S. Cl. ..... 400/715; 273/148 B; 340/710

[58] Field of Search ..... 400/715, 91, 94, 87; 273/148 B; 434/112, 432; 174/55 G

[56] References Cited

U.S. PATENT DOCUMENTS

| | | | |
|---|---|---|---|
| 4,081,068 | 3/1978 | Zapp | 400/715 |
| 4,201,489 | 5/1980 | Zapp | 400/715 |
| 4,378,553 | 3/1983 | McCall | 400/715 |
| 4,481,556 | 11/1984 | Berke et al. | 400/715 |
| 4,688,862 | 8/1987 | Fowler et al. | 400/715 |
| 4,862,165 | 8/1989 | Gart | 273/148 B |

FOREIGN PATENT DOCUMENTS

| | | | |
|---|---|---|---|
| 1913287 | 9/1970 | Fed. Rep. of Germany | 400/715 |
| 2430036 | 1/1976 | Fed. Rep. of Germany | 400/715 |

OTHER PUBLICATIONS

'Official Gazette', vol. #1105, No. 5, Patents of 8/29/89, p. 3455, 'Ergonomically-Shaped Hand Controller', Automated Patent Search Printout of Patent #4,862,165, dated 12/7/89.

IBM Technical Disclosure Bulletin, vol. 25, #9, 2/1983, 400/715, "Kana Keyboard with Palm Rest", A. Uchiyama, 2 pp.

*Primary Examiner*—Edgar S. Burr

*Attorney, Agent, or Firm*—Phillip A. Rein

[57] ABSTRACT

A portable palm, wrist, or forearm (appendage) rest is disclosed which includes the rest (1), adjustable supports (2), work surface, computer, typewriter, keyboard, or data input device attachment (3), means for reducing resistance to movement (4), and work surface protector (5). The said device provides a light, portable means for supporting a computer, typewriter, keyboard or data input device user's palms, wrists, or forearms in order to alleviate fatigue and increase productivity wherever the aforementioned device is used.

3 Claims, 3 Drawing Sheets

APPENDAGE REST

SPECIFICATION

1. Description

This invention relates in general to hand supports used for keyboard or data entry devices. More particularly, the invention concerns a type of hand, wrist, or forearm support that is particularly well suited for users that switch data entry or computing devices frequently.

2. Background Art

In recent years, typewriters and, moreover, personal computers have become an every day part of many peoples lives. It is not unusual for an individual to use such devices in more than one office during the course of a work day. The existing standand height of the home row of keys on a keyboard from the work surface is 30 mm, but many designs for not meet that standard and can range from 10 mm to over 60 mm. Further, the popularity and relative power of portable computers has increaded dramatically in recent years and many of their keyboards are much higher off the work surface than is comfortable for many users. Classic keyboard usage training has consistently instructed the user to keep their wrist parallel to the keyboard to increase speed, accuracy, and reduce fatigue. Yet, holding one's hands up in the air during the course of an entire workday, given the data input intensive nature of the modern workplace, can lead to fatigue and muscle pain in the hands, wrists, arms, shoulders, and back. In addition, the frequent use of modern input devices such as mice, digitizers, trackballs, light pens, etc. requires the users's arm be stretched away from the body exerting additional stress on the aforementioned portions of the body.

Allowing one's palms or wrists to rest comfortably while working has been found to increase productivity and decrease related physical maladies. Yet, such hand or forearm rests as are known by the applicant are rather large, immobile devices that are bound to the work surface. Moreover, the use of prior art devices has been limited to use with large, stationary, desktop computing devices without addressing the needs of the mobile or portable computer user. Nor have the needs of mouse, digitizer, trackball, or light pen users been addressed.

The inventor originally conceived of such a rest on the date of 6-22-1988, approximately one week after purchasing a portable computer for use while traveling.

DISCLOSURE OF THE INVENTION

A primary object of the present invention is to provide a portable palm, wrist, or forearm rest which allows the user to readily move the rest to other locations within an office.

Another object of the invention is to provide a rest that is small and light enough to accompany the user while traveling.

Another object of the invention is to provide a rest that can be adjusted for height variations in keyboards.

Yet another object of the invention is to provide a rest that will slide with the user's arm if so desired. This is so that the weight of the forearm may be placed upon it while using a mobile data input device such as a mouse.

Still another object of the invention is to provide a rest that while sliding with the user's arm if so desired, will not mar the finish of the work surface.

These objects of the invention are given only by way of example; thus, other desirable objectives and advantages inherently achieved by the disclosed structure may occur to those skilled in the art. Nonetheless, the scope of the invention is to be limited only by the appended claims. In a preferred embodiment of the invention, the Wrist rest is constructed of wood, plastic, foam or other suitable material and is a complementary shape. If desired, said material may be covered by an elastomeric or other similar pad. Depending upon the application, the device may include a suitable means to dissipate static electricity charges via a wire to a suitable ground.

It is preferred that the said device rest firmly on the work surface and the overall height and angle of the rest adjusted via changes in the size of the device. It is also within the scope of the invention to mount the device on adjustable supports in order to facilitate the adjustment of angle and height of the device While not necessary for all applications, a means of securing the rest to the work surface, typewriter, keyboard, or data input device may be desirable. Said attaching devices may be considered permanent or temporary and may take the form of, but should not be limited to, hook-and-loop (VELCRO) closures, adhesive tape, suitable cement, elastic bands, screws or bolts.

An additional element not necessary for all applications, is a means of protecting the work surface from physical damage during the normal usage of the rest.

Also, but not necessary for all applications, is a means for horizontal or vertical movement of the rest. This movement may be facilitated by mounting on wheels, rollers, bearings, devices, or other materials or surfaces designed to alter the resistance to movement of the rest on the work surface, work surface protector, or other operating surface. Said devices are integral or affixed to the rest, base, adjustable supports, or work surface protector.

DETAILED DESCRIPTION OF THE PREFERRED EMBODIMENT MANUFACTURE

Figure 1:
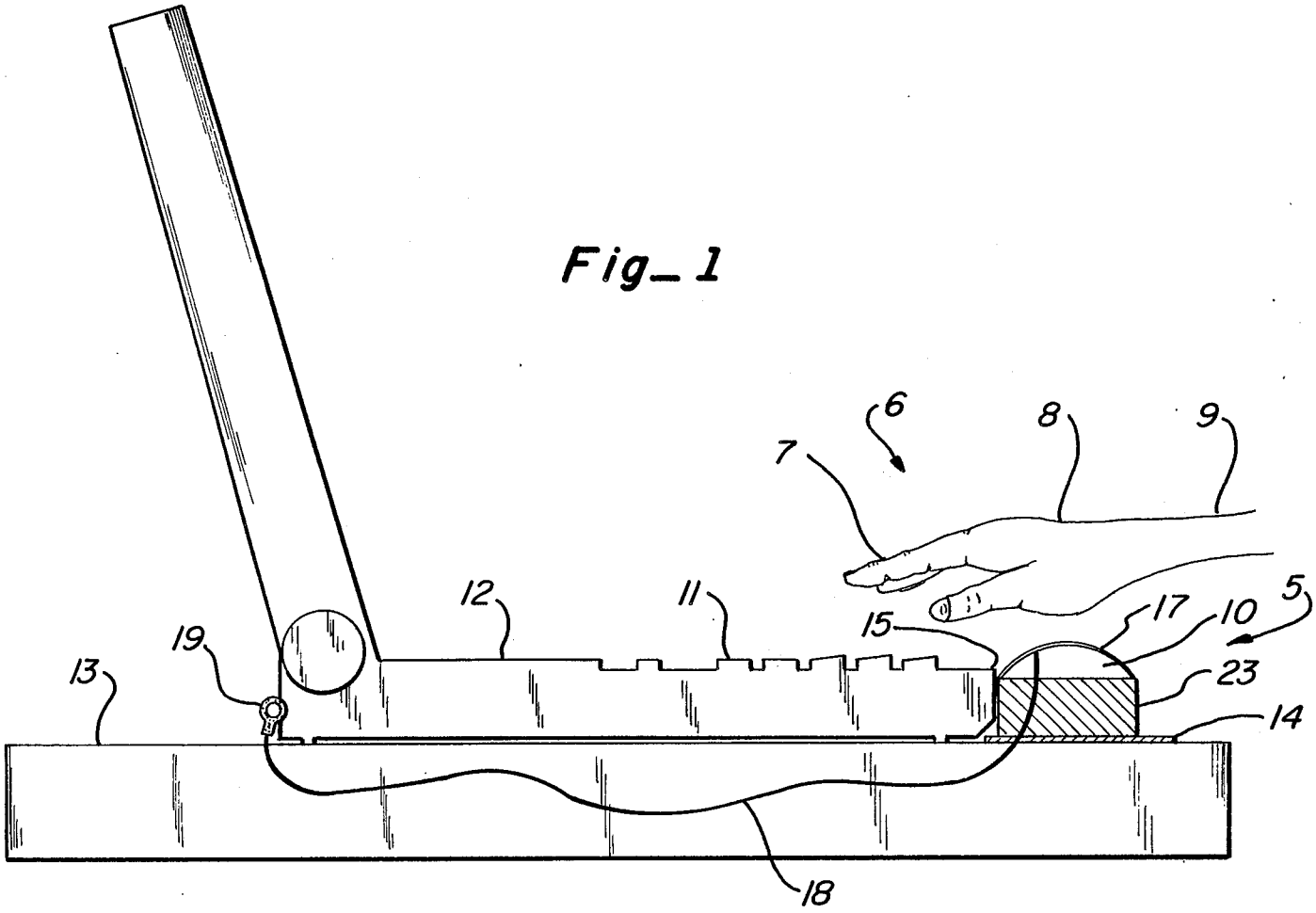
FIG. 1 present invention in relation to a computer and integral keyboard indicating an assembly according to the invention in which the device utilizes a base, elastomeric pad, static dissipating cover, attachment devices, and optional work surface protector.

The following is a description of rest(s) according to the invention, reference being made to the drawings in which like reference numerals identify like elements of structure in each of the several figures.

Referring to FIG. 1, a fragmentary view of the user's upper appendage 6 which comprises the hand 7, wrist 8, and forearm 9, is shown in relation to the rest 5, portable computer 12 with integral keyboard 11, and work surface 13. As indicated in FIG. 1, user's appendage 6 is supported during keyboard entry by a rest 5. The rest 5 is made from metal, plastic, wood, elastomeric, or other suitable material contoured in a complementary manner.

The rest comprises a base or base means 23 made from metal, plastic, wood, elastomeric, or other suitable material and shaped in a complementary manner. Base or base means 23 may optionally be covered With an elastomeric or similar pad or pad means 10 contoured in a complementary manner. Also optional is a covering or covering means of cloth, vinyl, plastic, teflon, or other suitable material 17. If desired, the covering 17 may facilitate the dissipation of static electrical charges via a conductive means comprising conducting wire 18 and suitable conducting connector 19 to the computer device chassis or other suitable ground (not illustrated). The height and angle of the present invention in relation to the portable computer 12 with integral keyboard 11, or work surface 13 may be adjusted by the user via the physical alteration of the size of the present invention with a suitable tool (not illustrated).

Figure 2:
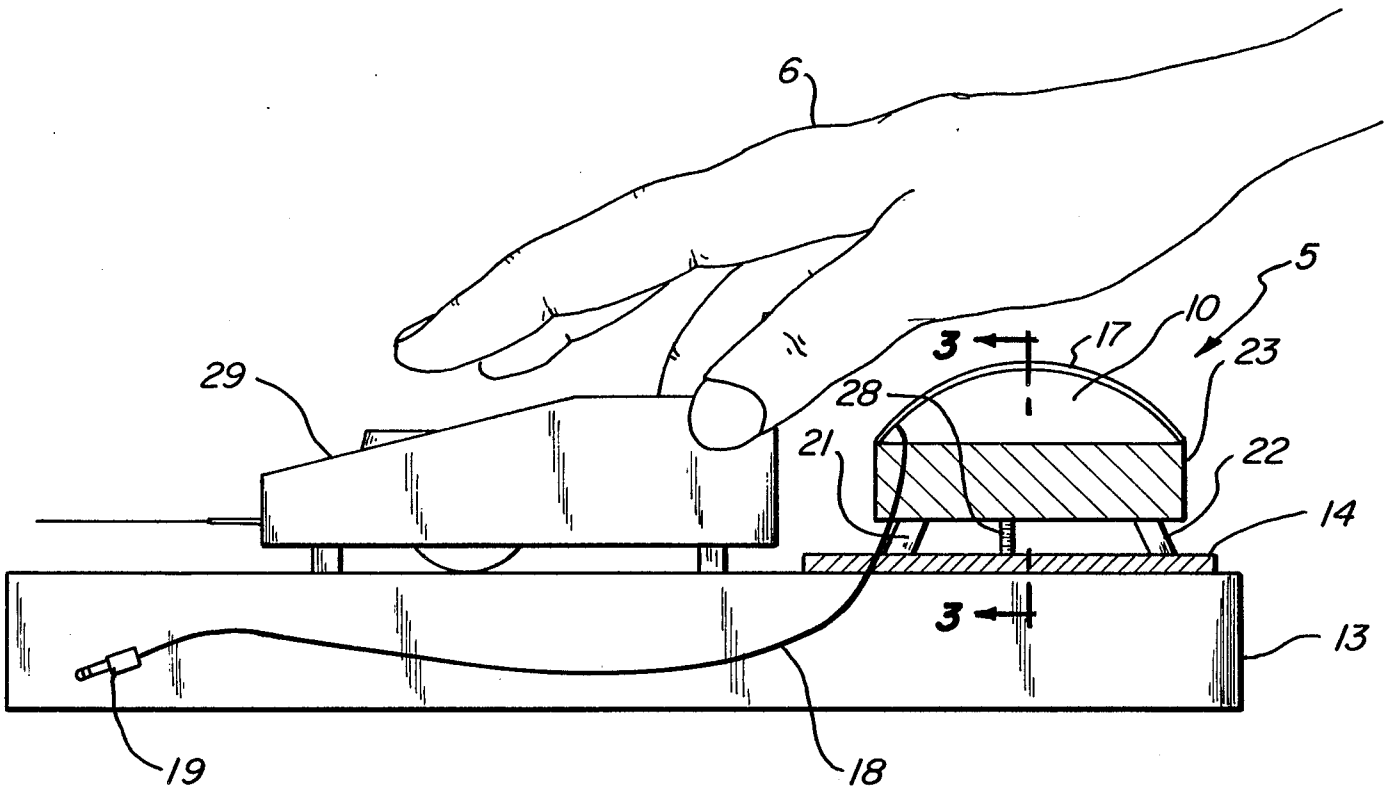
FIG. 2 shows a fragmentary perspective view of a user's hands as supported by the present invention in relation to a data input device indicating an alternative assembly according to the invention in which the device utilizes a base, elastomeric pad, static dissipating cover, attachment devices, optional work surface protector, and adjustable supports.

Referring to FIG. 2 alternately, the height and angle of said rest 5 in relation to the portable computer 12, integral keyboard 11, or work surface 13, may be adjusted via one or more adjustable supports 21, 22. Supports 21, 22 may be made from metal, wood, plastic, or other suitable material and may be positioned through use of hinges, cement, screws, or interference fit with the base 23. If desired, a work surface protector 14 made from metal, plastic, wood, or other suitable material may be attached to the work surface between the rest 5 and work surface 13.

FIG. 2, shows an alternate assembly of the rest according to the present invention in which the rest 5 comprises a base 23 made from metal, plastic, wood, elastomeric, or other suitable material and shaped in a complementary manner. Said base 23 may optionally be covered with an elastomeric or similar pad 10 contoured in a complementary manner. Also, optional is a covering of cloth, vinyl, plastic, teflon, or other suitable material 17. If desired, the covering 17 may facilitate the dissipation of static electrical charges via a conducting wire 18 and suitable conducting connector 19 to the computer device chassis or other suitable ground (not illustrated). The height and angle of said rest 5 in relation to the portable computer 12 with the keyboard 11 or work surface 13 may be adjusted via one or more adjustable supports 21, 22. Supports 21, 22 may be made from metal, wood, plastic, or other suitable material and may be positioned through the use of hinges, cement, screws, or interference fit with base 23.

Figure 3:
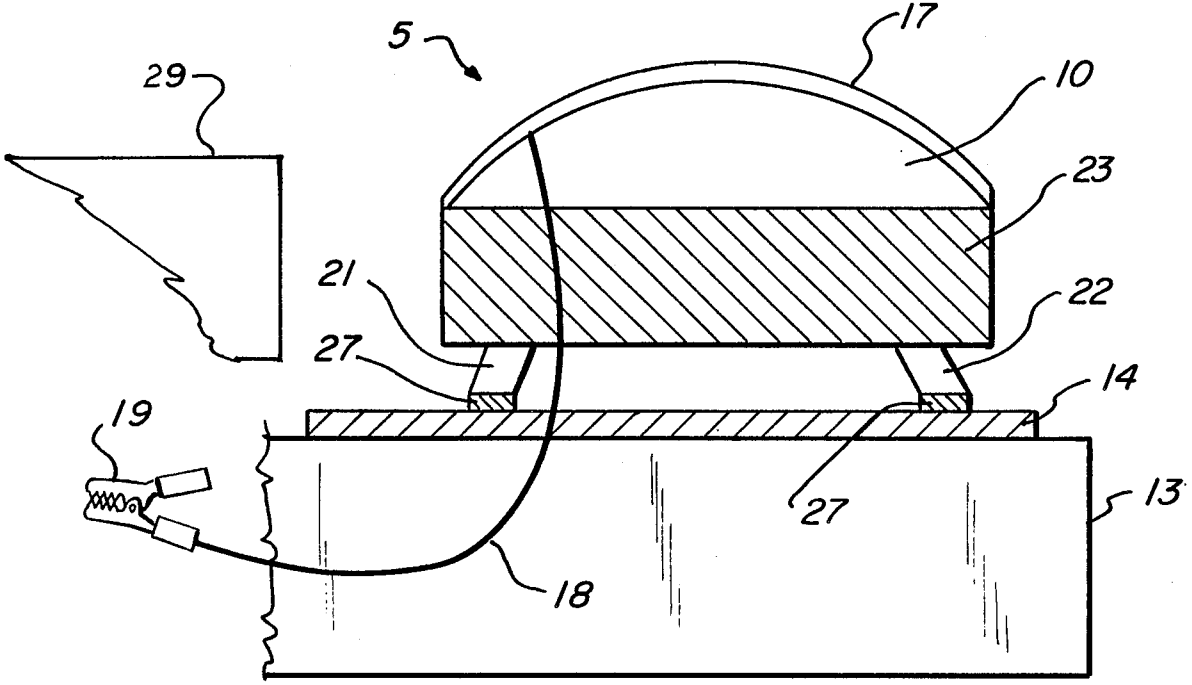
FIG. 3 shows a view partially in section taken along line 3-3 of FIG. 2 indicating the relative positions and geometries of the base, elastomeric pad, static dissipating cover, work surface protector, and devices used to reduce resistance to movement.

Referring to FIG. 3, shown is an alternate assembly of the rest 5 according to the present invention in which movement of the invention upon the work surface 13 or surface protector 14 may be facilitated by wheels, rollers, ball, bearings, teflon or other suitable material 27 attached to the rest 5.

It is within the scope of the present invention that the rest 5, optional pad 10, optional cover 17, base 23, or adjustable supports 21, 22, may be attached to the portable computer 12 with integral keyboard 11, work surface 13, or work protector 14 using hook-and-loop closures (VELCRO), cement, screws, adhesive tape, or other suitable material known as a connector or connector means 15 to inhibit movement with respect to the portable computer 12 with integral keyboard 11, work surface 13, or work surface protector 14.

Referring to FIG. 2, shown is an alternate assembly of the rest 5 according to the present invention in which the rest 5 comprises a base 23 made from metal, plastic, wood, elastomeric, or other suitable material and shaped in a complementary manner. Said base 23 may optionally be covered with an elastomeric or similar pad 10 contoured in a complementary manner. Also, optional is a covering of cloth, vinyl, plastic, teflon, or other suitable material 17. If desired, the covering 17 may facilitate the dissipation of static electrical charges via a conducting wire 18 and suitable conducting connector 19 to the computer device chassis or other suitable ground (not illustrated). The height and angle of said rest 5 in relation to the data input device 29 may be adjusted via one or more adjustable supports 21, 22. Supports 21, 22 may be made form metal, wood, plastic, or other suitable material and may be positioned through the use of hinges, cement, scres, or interference fit with base 23.

Referring to FIG. 3, shown is an alternate assembly of the rest according to the present invention in which movement of the invention upon the work surface 13 or work surface protector 14 may be facilitated by wheels, rollers, balls, bearings, teflon 27 or other suitable material 28 attached to adjustable supports 21, 22.

In use, the rest 5 is easily user customized by simply placing it next to the keyboard 11 and, after trial usage, physically altering the height of the rest with a suitable tool (not illustrated). Alternately, the adjustable supports 21, 22 on rest 5 5, may be positioned or attached as to adjust the angle and height as desired. In practice, the user may find that attachment of the rest 5 to the portable computer 12 with integral keyboard 11 or keyboard 16 via hook-and-loop closures 15, to provide a simple means of retaining the rest 5 in the desired position while providing for easy movement to another keyboard or location. Alternately, some users may prefer the rest 5 to move with the movement of the user's appendages 1, such as during the use of a mouse 29, digitizer, or light pen. In such applications, the user, following a trial usage and adjustment to the desired height and angle, may simplY allow the present invention to rest on the work surface 13 as desired without attachment to the data input device 29. In applications where the discharge of static electricity to a suitable ground is desirable, the user may connect one end of the optional conducting wire 18 to the optional cover 17, then connect the optional conducting connector 19 to an exposed ground on the computer chassis or other suitable ground (not illustrated). If desired, the work surface protector 14, may be simply placed on the work surface 13, or attached by a removable cement, adhesive tape, or other suitable means.

What is claimed:

1. An improved rest for appendages operable to be mounted on a work surface adjacent to a data input device such as a keyboard or computing device, comprising:

(a) said rest having a base mounted on the work surface adjacent the data input device being in a complementary shape relative thereto;

(b) means for releasably connecting said base to the data input device;

(c) support means connected to said base and engagable with the work surface to selectively adjust the work surface to selectively adjust the height of said base relative to the data input device to achieve a proper working relationship between the user's appendage and a keyboard of the data input device;

(d) a work surface protector secured to said base to contact the work surface;

(f) said work surface protector constructed of a material that reduces frictional contact between said rest and said work surface, whereby said rest may move easily and not damage the work surface;

(g) said work surface protector comprising a wheel member, a roller member, or a ball bearing.

2. An improved rest for appendages operable to be mounted on a work surface adjacent to a data input device such as a keyboard or computing device, comprising:

(a) a base means mounted on the work surface adjacent the data input device to receive an operator's appendage thereon;

(b) support means connected to said base mans operable to adjust spacing, angular relationship, and height between said base means and the work surface;

(c) pad means secured to said base means;

(d) covering mounted on said pad means to provide a protective surface;

(e) a work surface protector secured to said base to contact the work surface;

(f) said work surface protector constructed of a material that reduces frictional contact between said rest and said work surface, whereby said rest may move easily and not damage the work surface;

(g) said work surface protector comprising a wheel member, a roller member, or a ball bearing.

3. An improved rest for appendages operable to be mounted on a work surface adjacent to a data input device such as a keyboard or computing device, comprising:

(a) said rest having a base mounted on the work surface adjacent the data input device;

(b) means for releasably connecting said base to the data input device;

c) support means connected to said base and engagable with the work surface to selectively adjust the height of said base relative to the data input device to achieve a proper working relationship between the user's appendage and a keyboard of the data input device;

(d) conductive means connected to said base and a ground connection to dissipate static electrical charges from the operator and said base to ground; and (e) said means for releasably connecting being hook and loop connectors.

* * * * *